US008434745B2

(12) United States Patent
Abel

(10) Patent No.: US 8,434,745 B2
(45) Date of Patent: May 7, 2013

(54) INDIRECT HOT WATER COOLING DEVICE

(75) Inventor: Matthew W. Abel, Crystal, MN (US)

(73) Assignee: Pure Humidifier Co., Chaska, MN (US)

( * ) Notice: Subject to any disclaimer, the term of this patent is extended or adjusted under 35 U.S.C. 154(b) by 327 days.

(21) Appl. No.: 12/855,925

(22) Filed: Aug. 13, 2010

(65) Prior Publication Data

US 2012/0038070 A1 Feb. 16, 2012

(51) Int. Cl.
*B01F 3/04* (2006.01)

(52) U.S. Cl.
USPC ..... 261/127; 261/151; 261/152; 261/DIG. 76

(58) Field of Classification Search ..... 261/127, 261/151, 152, 155, 160, DIG. 10, DIG. 76
See application file for complete search history.

(56) References Cited

U.S. PATENT DOCUMENTS 1,884,534 A * 10/1932 Betz ..... 62/310
2,059,408 A * 11/1936 Stark ..... 261/128
2,869,831 A * 1/1959 Brockelsby ..... 62/171
3,648,438 A * 3/1972 Arbogast ..... 96/195
3,894,528 A * 7/1975 Stubblefield ..... 126/637
6,658,876 B1 12/2003 Richardson et al.
6,792,963 B2 9/2004 Kopel
7,578,967 B2 8/2009 Bell, Jr.

* cited by examiner

*Primary Examiner* — Charles Bushey
(74) *Attorney, Agent, or Firm* — Nelson R. Capes; Gerald E. Helget; Briggs and Morgan, P.A.

(57) ABSTRACT

An indirect hot water cooling device for a steam humidifier. The steam humidifier has a body of hot water and a drain valve for draining the body of hot water. The device includes a reservoir separate from the steam humidifier and receiving hot water from the steam humidifier drain valve; a connection from the steam humidifier drain valve to the reservoir; a re-circulating source of chilled water; a connection from the re-circulating source of chilled water to the reservoir; and a drain outlet from the reservoir. A method of draining a steam humidifier includes the steps of: draining the hot water in the humidifier to a separate reservoir; supplying re-circulating chilled water to the separate reservoir; and draining cooled water from the separate reservoir.

15 Claims, 3 Drawing Sheets

INDIRECT HOT WATER COOLING DEVICE

BACKGROUND OF THE INVENTION

The present invention relates to an indirect hot water cooling device for a steam humidifier.

When steam generating humidifiers need to be drained down for maintenance or for periodic removal of accumulated minerals, it is necessary to cool this boiling water below 140° F. Since waiting for the tank to cool down via the ambient air is such a slow an inconvenient method, some steam generating humidifiers use a device that mixes cooler municipal water with the hot water to achieve the desired mixed water temperature so that the effluent water is not too hot.

Recently, due to the lack of potable water in California, a restriction has been placed on the use of municipal water supplies to mix with and cool boiling/hot water. This restriction prevents the use of current designs which simply mix enough cool water to bring the temperature down to an acceptable temperature.

Accordingly, there is a need to provide a mechanism to chill or reduce the temperature of the water in the humidifier tank prior to discharging the water from the tank without mixing cooler municipal water with the hot water.

U.S. Pat. No. 6,792,963 discloses a hot water humidifier with an automatic siphon drain fed with cooler source water that is flushed via a drain. The hot water humidifier includes a humidifier tank supplied with the cooler source water. The automatic siphon is an inverted substantially U-shaped siphon conduit automatically operable with respect to the humidifier tank having one end coupled to the tank and the other end coupled to the drain. The humidifier also includes a source conduit coupled to and feeding the cooler source water to the humidifier tank. A valve controlling the cooler source water feeds the source water into the humidifier tank to maintain the temperature of an admixture of cooler source water and any preexisting tank water at or below a predetermined temperature during a flush cycle. The tank is flushed and drained via the automatic siphon based upon the level of the admixture in the tank and the level of admixture in the siphon. The source conduit which feeds water to the tank may be coupled to the humidifier tank via the siphon conduit.

U.S. Pat. No. 6,658,876 discloses a method and apparatus for collecting and chilling wastewater samples and the like and provides an insulated sample container vessel that has cooling coils therein for direct contact and heat transfer with a liquid in the container to rapidly cool the liquid. A refrigeration unit keeps the cooling coils cool. The liquid can be a sample which is required to be stored at 1-3 degrees Centigrade. The chiller is different from similar chillers in that the cooling coils simply are inserted in an insulated container, and can be removed therefrom when it is desired to transport the sample. The sample remains cool during transportation even without the cooling coils. The cooling coils are arranged in the ice chest such that coolant from the chiller enters through the upper coils and exits through the lower coils, causing the liquid sample in the upper part of the container to cool more than the sample in the lower part of the container. The liquid sample drifts down to the bottom, and the warmer sample in the container drifts upwardly, so there is no need for a mechanical stirrer to circulate the sample to make it uniformly cool. The container has a fitting that enables a selected sample to be added to the container interior while the container remains closed.

U.S. Pat. No. 7,578,967 discloses an apparatus and a system that reduces water wasting, when compared to contemporary sterilizer systems. The apparatus eliminates the need for needle or other valves in sterilizers or sterilizer systems and, thus reduces the cool water from running constantly, so as to conserve water. The apparatus can be combined with conventional sterilizers and/or sterilizer systems to collapse steam from these sterilizers and/or sterilizer systems and provide it to a drain line or drain at a temperature sufficiently cool in accordance with building codes (typically less than 140 degrees F.).

None of these patents discloses an indirect hot water cooling device for a steam humidifier that uses a closed-loop chilled water supply as a source of a heat sink to a cooling tank separate from the steam humidifier tank. For example, U.S. Pat. No. 6,792,963 pipes cool water directly into the humidifier tank. Also, this patent does not disclose a closed-loop chilled water supply, so that the cool water is not recycled.

None of these patents discloses an indirect hot water cooling device for a steam humidifier that uses a heat exchanger to supply chilled water to a cooling tank separate from the steam humidifier tank.

None of these patents discloses an indirect hot water cooling device for a steam humidifier that uses a separate, cleanable cooling tank to receive hot water drained from the steam humidifier.

Other advantages and features of the present invention will be further described below.

SUMMARY OF THE INVENTION

A principle object and advantage of the present invention is that it uses a closed loop chilled water supply as a source of a heat sink. The chilled water flows inside tubing formed into a helical cylinder (heat exchanger).

Another principle object and advantage of the present invention is that includes a heat exchanger that is constantly submersed in a water bath tank.

Another principle object and advantage of the present invention is that it is cleanable. The hot water side of the heat exchanger will collect mineral build-up due to the nature of the concentrated humidifier water. The present invention permits the tank containing the heat exchanger to be readily cleaned.

Another principle object and advantage of the present invention is that the heat exchanger coil is a completely removable and replaceable part of the device. The heat exchanger coil is not welded to the removable cover but secured by a flexible hose and hose clamps.

Another principle object and advantage of the present invention is that volume of water in the tank acts a thermal storage sink so that when the tank drain valve first opens there is a greater instantaneous cooling capacity available when the incoming hot water flow is the greatest.

Another principle object and advantage of the present invention is that the tank has a set of baffles so that the tempered water leaving the tank is the coldest water (bottom).

Another principle object and advantage of the present invention is that the inlet to the tank has a changeable orifice to adjust the maximum allowable flow in to the tank.

A feature of the present invention is that it may be piped with an overflow bypass so in the event that the fill valve of the humidifier steam generator sticks open the generator tank will not overfill.

DETAILED DESCRIPTION OF THE PREFERRED EMBODIMENT

Figure 1:
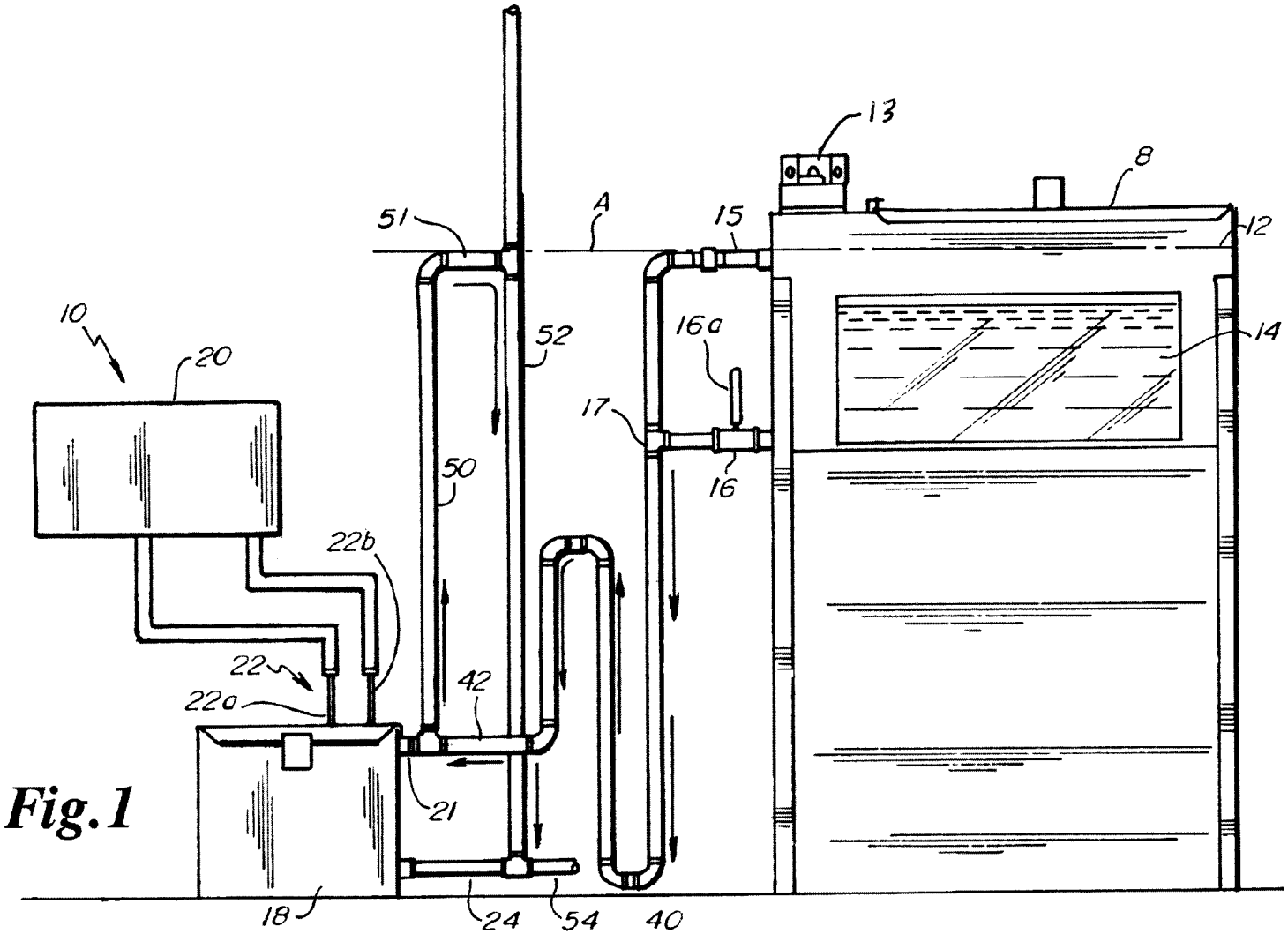
FIG. 1 is a schematic of a steam humidifier according to the present invention.

FIG. 1 is a schematic showing the components of the present invention.

In one aspect, the present invention is a steam humidifier 8 having a tank 12 holding a body of water 14. Humidifier 8 has a drain valve 16 typically at or below the lowest level of the body of water 14. Humidifier 8 also has an overflow pipe 15 at the highest desired level of the body of water 14. Drain valve 16 has valve operating handle 16*a*, which allows the drain valve 16 to be open or closed, for the purpose of draining some or all of the body of water 14 from the humidifier 8.

FIG. 1 also shows typical piping for draining the humidifier 8. Drain valve 16 is connected to P-trap 40. The drain line from a steam humidifier must be trapped immediately upon exiting the unit to prevent steam from rising out of the drain pipe and condensing inside the humidifier unit.

Overflow pipe 15 is also connected to P-trap 40, suitably with a T-joint 17.

In a standard installation without the present invention, P-trap 40 will be connected to a drain pipe 54.

Steam humidifier 8 has, as part of the objects and advantages of the present invention, an indirect hot water cooling device 10. The device 10 will permit the hot water from the drain valve 16 of humidifier 8 to be cooled before being flushed to the environment, as is now further described.

Indirect hot water cooling device 10 further comprises a reservoir 18 separate from the tank 12 of the humidifier 8. The reservoir 18 receives hot water from the drain valve 16 through P-trap 40 and pipe segment 42, and through hot water inlet 21. Cooled water exits the reservoir 18 through drain outlet 24, which in turn connects to drain pipe 54.

Reservoir overflow pipe 50 is connected, suitably by a T-joint, to pipe segment 42 and hot water inlet 21. Suitably, overflow pipe 50 is connected by transverse pipe segment 51 to vertical pipe segment 52, which in turn connects to drain pipe 54. Transverse pipe segment 51 should be at the same level as humidifier overflow pipe 15.

Indirect hot water cooling device 10 further comprises a re-circulating source of chilled water 20. Source 20 is connected to reservoir 18 by connection 22, which in turn comprises a chilled water inlet 22*a* and a chilled water outlet 22*b*.

Figure 2:
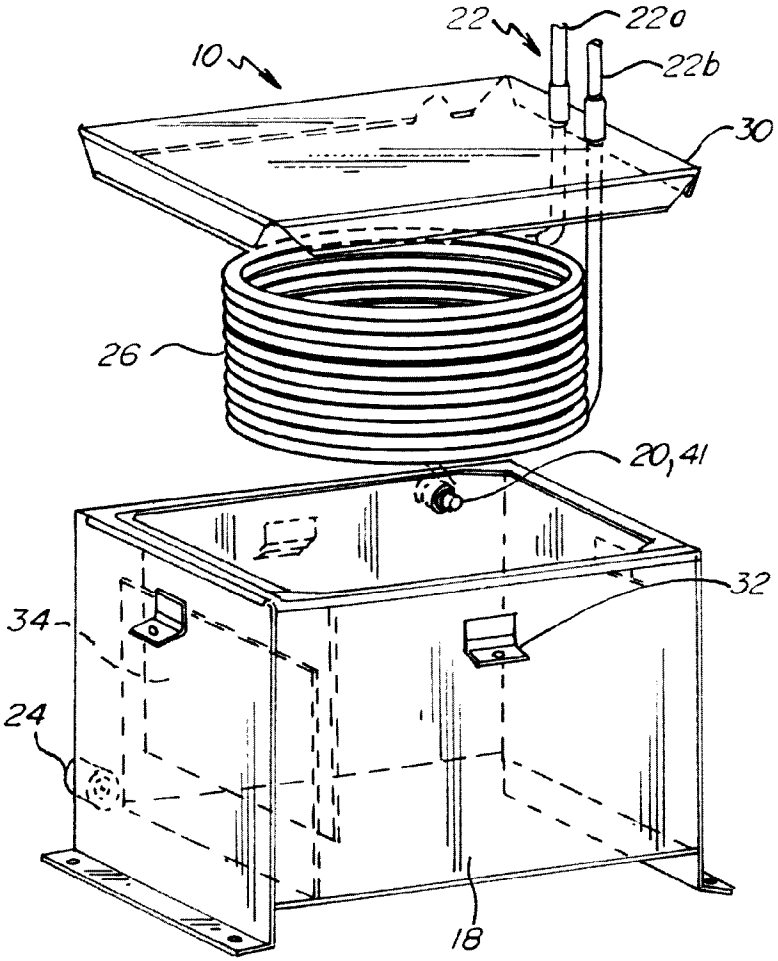
FIG. 2 is an exploded perspective view of the indirect hot water cooling device of the present invention.
Figure 4:
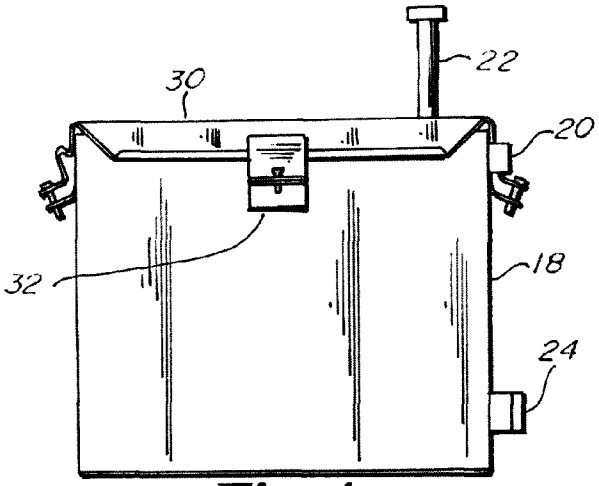
FIG. 4 is an elevational view of the indirect hot water cooling device of the present invention.
Figure 5:
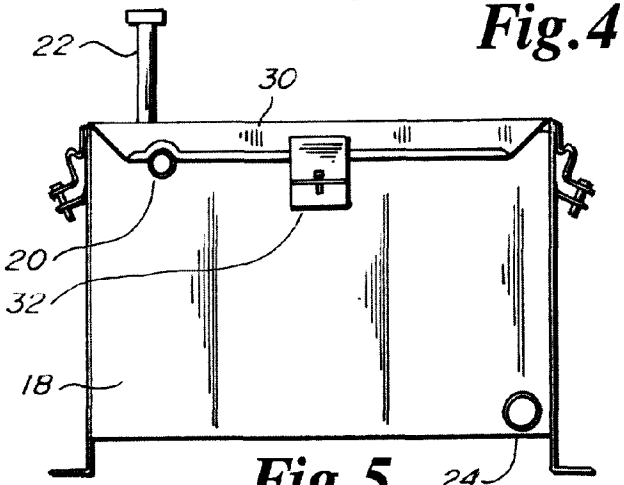
FIG. 5 is a second elevational view of the indirect hot water cooling device of the present invention.
Figure 6:
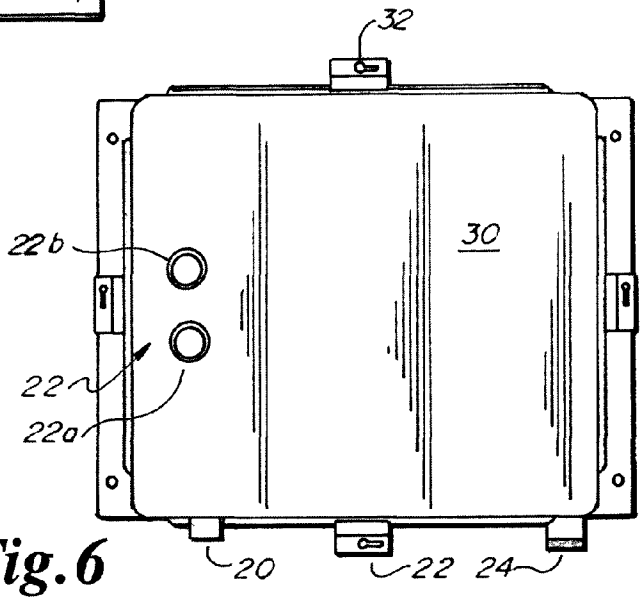
FIG. 6 is a top view of the indirect hot water cooling device of the present invention.

Turning to FIG. 2, additional details of the indirect hot water cooling device 10 will now be described.

Device 10 further comprises a heat exchanger 26 mounted within reservoir 18 and connected to source of chilled water 20 by chilled water inlet 22*a* and chilled water outlet 22*b*. Chilled water from source 20 re-circulates through heat exchanger 26. It will be understood that, as chilled water passes through the heat exchanger 26, heat from the water in reservoir 18 is absorbed, cooling the water in reservoir 18.

Heat exchanger 26 is removable from the reservoir 18 for cleaning the reservoir 18 and the heat exchanger 26 of mineral buildup from the water in reservoir 18.

Preferably, reservoir 18 has a removable cover 30, suitably held to the reservoir 18 by clamps 32. Heat exchanger is connected to the removable cover 30 by flexible connections 22*c*, 22*d*, such as hose clamps, and therefore heat exchanger 26 is removable from the cover 30.

Figure 3:
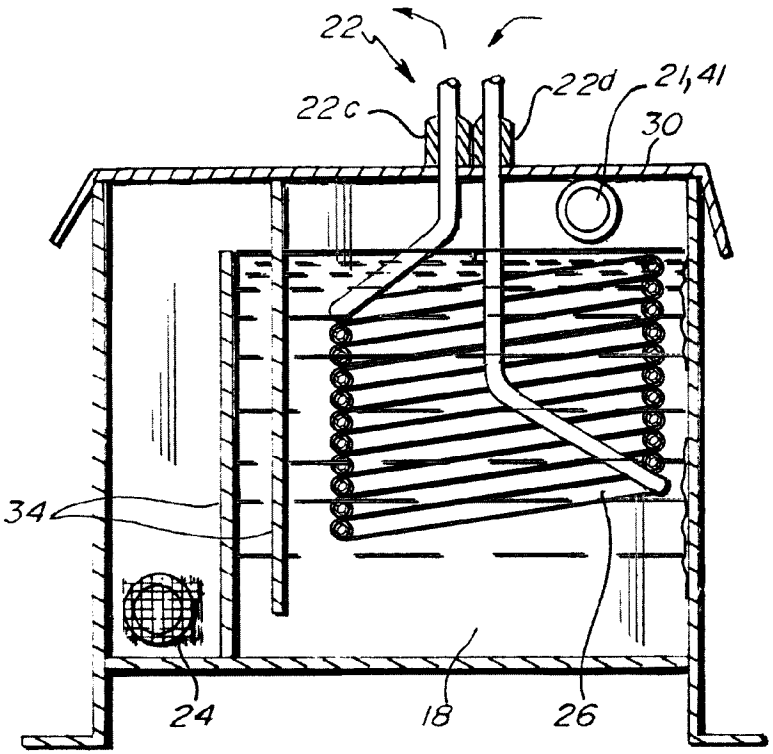
FIG. 3 is a cross-section of the indirect hot water cooling device of the present invention.

Turning to FIG. 3, additional detail will be presented.

Hot water inlet 21 is preferably located near the top of reservoir 18, and drain outlet 24 near the bottom of reservoir 18. Hot water from the humidifier 8 enters the reservoir 18 through hot water inlet 21. Encountering heat exchanger 26, this entering hot water is cooled and, being heavier, sinks towards the bottom of reservoir 18, displacing remaining hot water toward the heat exchanger 26 which in turn is cooled and sinks. The volume of water in the reservoir 18 thus acts as a thermal storage sink so that when the drain valve 16 is first opened there is a greater instantaneous cooling capacity available when the incoming hot water flow is the greatest.

Hot water inlet 21 may preferably have metering orifice 41, which allows the rate of flow of hot water from the humidifier drain valve 16 to be regulated.

Reservoir 18 may preferably include baffles 34 that the water near the bottom of the reservoir 18, which is coldest, will drain out of reservoir 18 first. Operation of the baffles should be clear from FIG. 3, which is exemplary only.

Operation of the present invention may now be described.

Water 14 in the tank 12 of the steam humidifier will typically have a temperature of about 212 F. When it is desired to drain humidifier 8 for cleaning, drain valve 16 is opened by operating handle 16*a*. Hot water 14 flows through P-trap 40 and pipe segment 42 into hot water inlet 21, where the inflow may be regulated by metering orifice 41. Upon entering the reservoir 18, the hot water is chilled by heat exchanger 26, sinks to the bottom of the reservoir 18, then exits the reservoir 18 through drain outlet 24. By the time water reaches the drain outlet 24, it will have been cooled from 212 F to about 140 F, depending on environmental regulations. Water then is drained to the environment through drain pipe 54.

In the event that the humidifier fill valve 13 becomes locked/stuck in an open position, water will continue to flow through the illustrated piping, in turn overflowing the reservoir 18 through inlet 21, and rising through overflow pipe 50 until it reaches the level shown by line A in FIG. 1, which is the same level as the maximum water level in the humidifier tank 12. Water will then flush through vertical pipe segment 52 to the drain pipe 54. Water will cease flushing when the level of water in humidifier tank 12 falls below line A.

Operating requirements for the system will depend on several factors, including the size of humidifier tank 12 and environmental requirements for the temperature of water exiting the indirect cooling device 10. Typically, the source 20 of chilled water will have a temperature of about 48 F and may supply chilled water to the heat exchanger 26 at a rate of about 4 gallons per minute. Supply pressure may be 55 to 100 psi. Typically, the device 10 will chill water from 212 F to about 140 at a flow rate of about 1 gallon per minute.

A method of draining a steam humidifier 8 having a body of hot water 14 and a drain valve 16 comprises the steps of: draining the body of water 14 through the drain valve 16 into a separate reservoir 18; supplying chilled water from a source 20 of chilled water to the separate reservoir 18; passing hot water drained from the humidifier through a heat exchanger 26 mounted in the separate reservoir 18, thereby exchanging heat from the hot water to the chilled water, producing cooled water; draining the cooled water from the reservoir 18; and re-circulating the water in the heat exchanger to the source 20 of chilled water.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described below. All publications, patent applications, patents, and other references mentioned herein are incorporated by reference in their entirety to the extent allowed by applicable law and regulations. In case of conflict, the present specification, including definitions, will control.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. An indirect hot water cooling device for a steam humidifier, the steam humidifier having a body of hot water and a drain valve for draining the body of hot water, the device comprising:

(a) a reservoir separate from the steam humidifier and receiving hot water from the steam humidifier drain valve;

(b) a connection from the steam humidifier drain valve to the reservoir;

(c) a re-circulating source of chilled water;

(d) a connection from the re-circulating source of chilled water to the reservoir; and (e) a drain outlet from the reservoir.

2. The device of claim 1, further comprising a heat exchanger mounted within the reservoir and connected to the source of chilled water.

3. The device of claim 2, wherein the heat exchanger is removable from the reservoir.

4. The device of claim 3, wherein the reservoir further comprises a removable cover and wherein the heat exchanger is removably connected to the removable cover.

5. The device of claim 1, further comprising a baffle mounted within the reservoir and partially separating hot water from the steam humidifier from cooler water that has been cooled by the source of chilled water.

6. The device of claim 1, further comprising a metering orifice between the steam humidifier drain valve and the reservoir.

7. The device of claim 1, further comprising an overflow bypass valve connected to the reservoir.

8. A steam humidifier with an indirect hot water cooling device, the steam humidifier comprising a body of hot water and a drain valve for draining the body of hot water, the indirect hot water cooling device comprising:

(a) a reservoir separate from the steam humidifier and receiving hot water from the steam humidifier drain valve;

(b) a connection from the steam humidifier drain valve to the reservoir;

(c) a re-circulating source of chilled water;

(d) a connection from the re-circulating source of chilled water to the reservoir; and (e) a drain outlet from the reservoir.

9. The steam humidifier of claim 8, further comprising a heat exchanger mounted within the reservoir and connected to the source of chilled water.

10. The steam humidifier of claim 9, wherein the heat exchanger is removable from the reservoir.

11. The steam humidifier of claim 10, wherein the reservoir further comprises a removable cover and wherein the heat exchanger is removably connected to the removable cover.

12. The steam humidifier of claim 8, further comprising a baffle mounted within the reservoir and partially separating hot water from the steam humidifier from cooler water that has been cooled by the source of chilled water.

13. The steam humidifier of claim 8, further comprising a metering orifice between the steam humidifier drain valve and the reservoir.

14. The steam humidifier of claim 8, further comprising an overflow bypass valve connected to the reservoir.

15. The steam humidifier of claim 8, wherein the connection from the steam humidifier drain valve to the reservoir further comprises a P-trap.

* * * * *